United States Patent [19]

Morrison

[11] Patent Number: 4,461,341

[45] Date of Patent: Jul. 24, 1984

[54] COOLING SYSTEM FOR HYDRAULIC POWERED APPARATUS

[76] Inventor: Donald R. Morrison, 6228 Eagle Peak Dr., Charlotte, N.C. 28214

[21] Appl. No.: 359,027

[22] Filed: Mar. 17, 1982

[51] Int. Cl.[3] ..... F28D 7/02

[52] U.S. Cl. ..... 165/51; 60/456; 165/125

[58] Field of Search ..... 165/51, 125; 184/104 B; 123/41.33, 196 AB; 60/456, DIG. 5

[56] References Cited

U.S. PATENT DOCUMENTS

| | | | |
|---|---|---|---|
| 914,822 | 3/1909 | Goudard et al. | 165/125 |
| 3,727,712 | 4/1973 | Colloton | 165/51 X |
| 4,066,047 | 1/1978 | Vidakovic et al. | 123/41.33 X |
| 4,320,986 | 3/1982 | Morrison | 404/112 |

FOREIGN PATENT DOCUMENTS

| | | | |
|---|---|---|---|
| 42112 | 9/1959 | Poland | 165/51 |

*Primary Examiner*—Sheldon J. Richter
*Attorney, Agent, or Firm*—B. B. Olive

[57] ABSTRACT

An improved apparatus, for cooling hydraulic fluid in a small horsepower internal combustion gasoline engine powered hydraulic drive system, mounts the blower and oil pump concentric of and so that they are driven by the engine drive shaft and includes a finned tube heat exchanger mounted between the blower and oil pump through which hot hydraulic fluid passes and is aided in cooling by air forced over the fins by the blower. An operator controlled relief valve is incorporated into the system.

2 Claims, 8 Drawing Figures

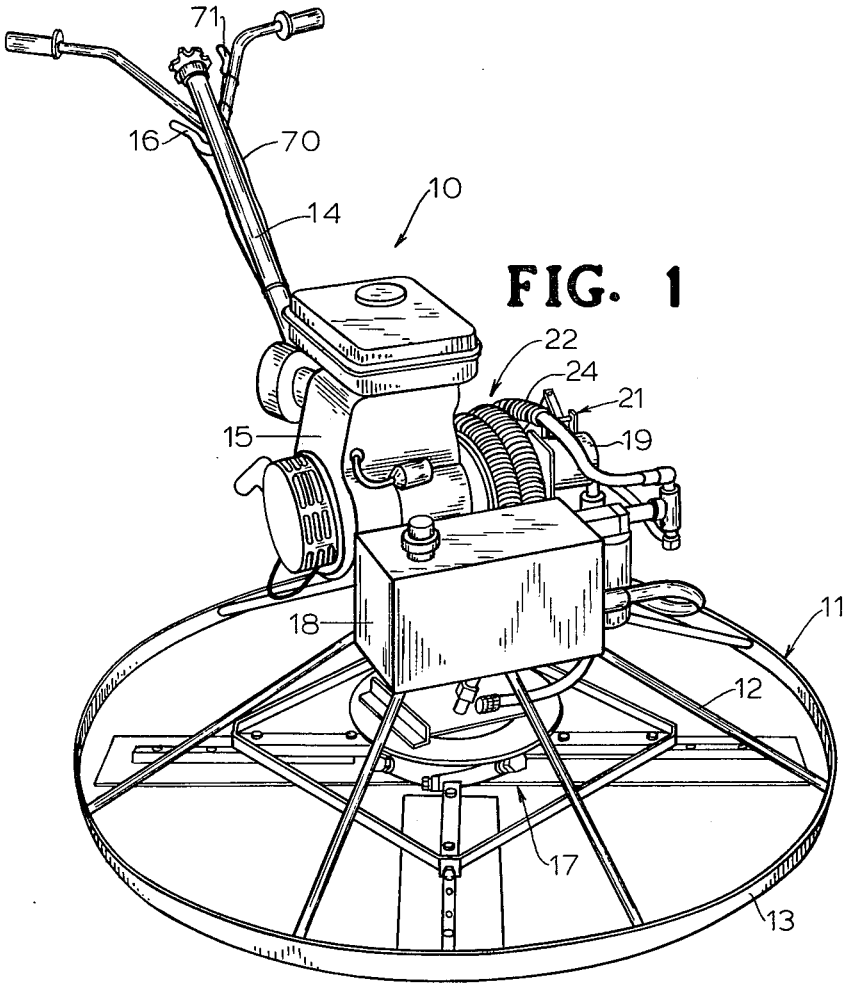
FIG. 1
FIG. 7
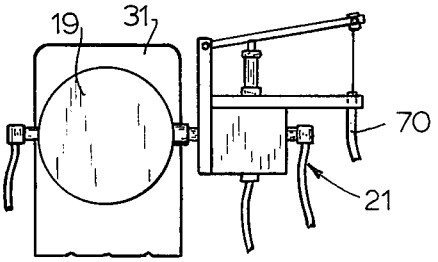
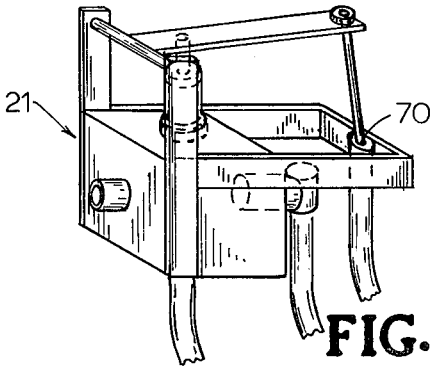
FIG. 8

COOLING SYSTEM FOR HYDRAULIC POWERED APPARATUS

CROSS REFERENCE TO RELATED APPLICATIONS

The subject matter of the present invention relates to and is particularly adapted for use with a hydraulically-powered rotary trowel as disclosed in applicant's copending patent application Ser. No. 132,636, filed Mar. 21, 1980, entitled "Motor Powered Rotary Trowel", now U.S. Pat. No. 4,320,986. The subject matter of the present invention also relates to and is an improvement upon applicant's copending patent application Ser. No. 325,277, filed Nov. 27, 1981, entitled "Hydraulic Pumping-Cooling Apparatus".

TECHNICAL FIELD

The invention relates to hydraulic drive systems such as used in conjunction with small horsepower, internal combustion, gasoline engine driven trowels for smoothing concrete. More specifically, the present invention relates to an improved means for driving an oil pump and to means for cooling the oil and all being driven or powered by a small horsepower, internal combustion, gasoline engine.

BACKGROUND ART

Numerous devices are driven by hydraulic motors utilizing pressurized oil developed by a relatively low horsepower gasoline engine driven pump. Applicant's copending application Ser. No. 132,636, previously referred to represents such an apparatus as does the apparatus disclosed in U.S. Pat. No. 3,459,109. Such apparatus requires some means for driving an oil pump and this is usually done by a belt and pulley arrangement driven by the gasoline engine drive shaft. Such apparatus also frequently requires some means for cooling the oil used as the hydraulic fluid. This has been found to be true in the case of small gasoline-powered, hydraulically-driven trowels used for smoothing concrete particularly when the trowel is heavily loaded in extremely hot weather. The typical arrangement employed for cooling the hydraulic fluid has required the use of some type of blower or fan with a separate belt and pulley arrangement for driving the blower or fan off the engine shaft and a separate, bulky radiator arrangement.

Prior to applicant's pending patent application Ser. No. 325,277, so far as applicant is aware, there had not been available a compact oil pump drive and oil cooling arrangement adapted for use with hydraulically-driven apparatus powered by a small horsepower gasoline engine. Thus, applicant's pending application Ser. No. 325,277 provided an improved and more compact oil pumping and oil cooling apparatus for use with rotary trowels used for smoothing concrete.

Applicant's present application has gone further and provides improvements to pending application Ser. No. 325,277 and gives an even more compact system in addition to the improvements.

DISCLOSURE OF INVENTION

Hydraulic fluid in a system having a gasoline engine as the source of power is cooled by means of a blower mounted on the engine drive shaft which also drives the oil pump. The blower and pump are part of an integral compact assembly mounted on the engine and which also includes a finned tube heat exchanger mounted between the blower and the oil pump and through which hot hydraulic fluid passes and is aided in its cooling by air forced over the fins by the blower. An operator handle controlled relief valve allows trowel blade slippage to be easily adjusted according to the nature of the surface being worked.

DESCRIPTION OF THE DRAWINGS

FIG. 1 is a pictorial view of a rotary trowel of the type incorporating the apparatus of the present invention.

FIG. 7 is a side elevation view of the hydraulic pump and novel pressure relief valve control arrangement incorporated into the present invention apparatus.

FIG. 8 is a pictorial view of the pressure relief valve control arrangement of FIG. 7.

BEST MODE FOR CARRYING OUT THE INVENTION

Figure 2:
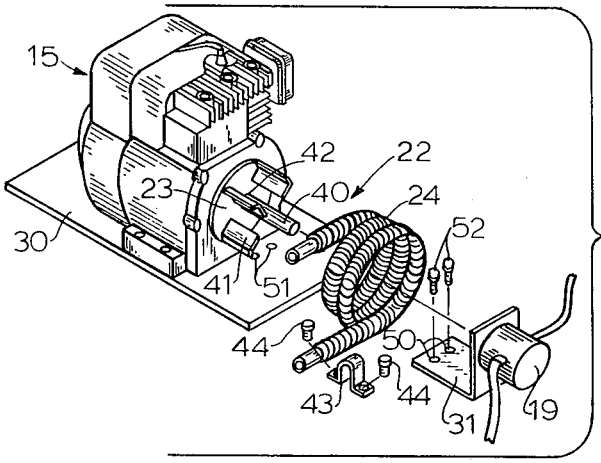
FIG. 2 is an exploded perspective view illustrating a gasoline engine of the type employed in the present invention along with the finned tube heat exchanger and hydrualic pump also employed.
Figure 3:
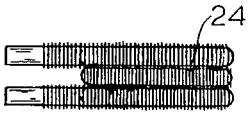
FIG. 3 is a plan view of the finned tube heat exchanger employed.
Figure 4:
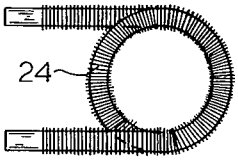
FIG. 4 is a side elevation view of the finned tube heat exchanger of FIG. 3.

With reference to the drawings, a concrete trowel 10 incorporates the improved hydraulic drive and fluid cooling systems of the present invention. Trowel 10 comprises generally a frame 11, structural ribs 12, guard ring 13, handle 14, low horsepower gasoline engine 15, remote controls 16, trowel blade assembly 17, hydraulic fluid reservoir 18, fluid pump 19, hydraulic motor 20 operator controlled relief valve 21, and fluid cooling assembly 12 made up of blower 23 and finned tube 24.

Trowel 10 has a mounting plate 30 held in place by structural ribs 12 and other structural members (not shown). Plate 30 is positioned centrally of guard ring 13 and above trowel blade assembly 17. Plate 30 fixedly mounts engine 15 and hydraulic pump 19 which is mounted on bracket 31. FIG. 2 best illustrates schematically and in exploded view how engine 15 and pump 19 are mounted on plate 30.

Figure 5:
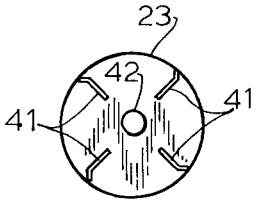
FIG. 5 is a plan view of the blower of the present invention apparatus.

Engine 15 is so positioned that its drive shaft 40 extends outwardly therefrom in a plane substantially parallel to that of trowel blade assembly 17. A fluid cooling assembly 22 is mounted adjacent engine 15 and includes a blower 23 driven by drive shaft 40 thereof. Blower 23 is integrally secured on shaft 40 adjacent the sidewall of engine 15 with blower vanes 41 extending outwardly in a plane parallel with drive shaft 40. Shaft 40 passes through hole 42 in blower 23 (see FIG. 5) and is keyed thereto so that blower 23 and vanes 41 rotate with or are driven by shaft 40 of engine 15.

A preshaped, multi-coiled, finned tube 24 provides a compact heat exchanger and is situated adjacent engine 15 and surrounds blower 23, vanes 41 and shaft 40. Finned tube 24 is fixedly secured to plate 30 by bracket 43 and bolts 44. Finned tube 24 is held in place by its rigidity and bracket 43.

As previously mentioned, hydraulic pump 19 is mounted on bracket 31 in a fixed relation. Bracket 31 in turn is secured to plate 30 so that holes 50 in bracket 31 and holes 51 in plate 30 align and bolts 52 fixedly secure bracket 31 and pump 19 in place on plate 30. Pump 19 is so positioned that the free end of drive shaft 40 engages with pump 19 and the turning of shaft 40 drives pump 19. As can best be seen in FIGS. 1 and 2, finned tube 24 is positioned between engine 15 and hydraulic pump 19 and surrounds blower 23 and drive shaft 40. As drive shaft 40 rotates and drives blower 23, vanes 41 draw outside air in around bracket 31 supporting pump 19 and forces this air out around the fins of finned tube 24. Thus, cool air is drawn in and blown out around tube 24 thereby providing a cooling effect to the fluid passing through tube 24.

Although not seen in FIGS. 1 and 2, a hydraulic motor 20 is situated below plate 30 and is designed to drive trowel blade assembly 17. Pump 19 in turn drives hydraulic motor 20 by the hydraulic fluid pumped through the system from hydraulic fluid reservoir 18 which is also supported from plate 30 but it not so illustrated.

Figure 6:
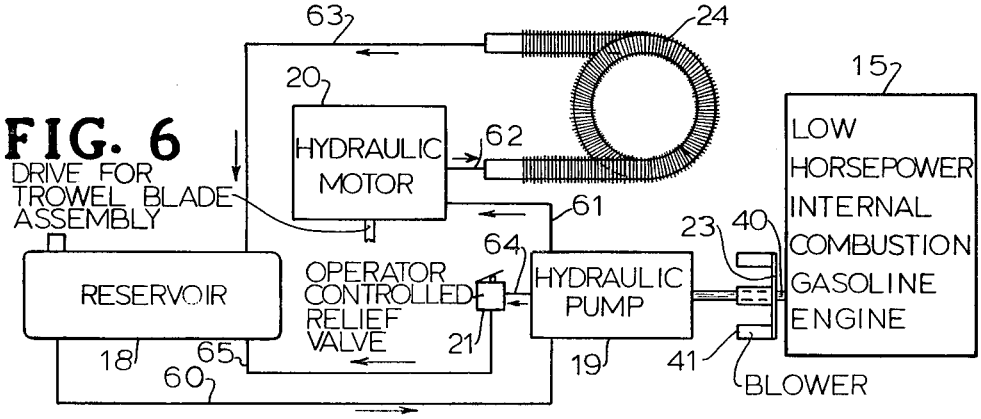
FIG. 6 is a schematic diagram of a typical small horsepower gasoline engine powered hydraulic system according to the invention.

Turning now to an explanation of FIG. 6, which is a schematic diagram of the invention hydraulic drive and hydraulic fluid cooling system, hydraulic fluid for the system is stored in reservoir 18. Reservoir 18 supplies fluid to pump 19 through hydraulic line 60. As pump 19 is driven by engine 15 through shaft 40, fluid is supplied to hydraulic motor 20 through hydraulic line 61 from hydraulic pump 19. The hydraulic fluid is used to drive motor 20 which in turn through its output drive shaft drives trowel blade assembly 17. Fluid exiting motor 20 is fed through line 62 which is in turn connected to one end of finned tube 24. The other end of tube 24 is connected with hydraulic line 63 which directs the fluid back to reservoir 18. As the fluid passes through finned tube 24, the fluid is cooled by blower 23 driven by shaft 40 of engine 15. Blower 23 directs cooling air through and around finned tube 24. Also incorporated into this system is relief valve 21. Hydraulic line 64 delivers fluid from pump 19 through valve 21 and through hydraulic line 65 directs the fluid back into reservoir 18. Relief valve 21 has a cable 70 which through appropriate linkage sets relief valve 21 to control the relief pressure. Cable 70 is secured at one end to linkage of valve 21 (see FIGS. 7, 8) and cable 70 is secured along handle 14 and has a lever 71 secured adjacent the handle. Control of pump 19 is made through the setting of valve 21 by lever 71 and cable 70. Thus, slippage of the trowel blades can be quickly adjusted according to the nature of the surface being worked.

I claim:

1. In a hydraulic powered apparatus, comprising:

(a) an internal combustion engine mounted on a base structure and having a drive shaft extending therefrom;

(b) a hydraulic fluid cooling assembly comprising:

(i) a blower assembly mounted immediately adjacent said engine, said assembly having a blower mounted on and integrally secured to said drive shaft, said blower being mounted concentric of said shaft and rotatable therewith so that the vanes of said blower create a stream of incoming and outwardly forced air; and (ii) a multi-coiled finned tube heat exchanger, said heat exchanger being mounted adjacent said engine and surrounding said blower assembly and concentric with said drive shaft so as to allow cooling air from said blower to be directed across said finned tube heat dissipating means to cool heated hydraulic fluid passing therethrough; and (c) a hydraulic pump mounted on said base structure adjacent said heat exchanger and concentric with said drive shaft of said engine and directly connected to the end of said shaft opposite said engine; and wherein said blower assembly, said fluid cooling assembly and said fluid pump are formed as a unified structure.

2. In a hydraulic powered apparatus as claimed in claim 1 wherein said pump is connected to a hydraulic motor, a reservoir and an operator-controlled relief valve arranged such that dependent on positioning of said relief valve said pump can pump to said reservoir through said motor or through said relief valve.

* * * * *